US008985281B2

(12) United States Patent
De Coi et al.

(10) Patent No.: US 8,985,281 B2
(45) Date of Patent: Mar. 24, 2015

(54) ELEVATOR SHAFT POSITION MEASUREMENT APPARATUS

(75) Inventors: Beat De Coi, Sargans (CH); Steven Freedman, Minneapolis, MN (US); Jan Giger, Jenaz (CH); Tobias Leutenegger, Chur (CH)

(73) Assignee: Cedes AG, Landquart (CH)

( * ) Notice: Subject to any disclaimer, the term of this patent is extended or adjusted under 35 U.S.C. 154(b) by 372 days.

(21) Appl. No.: 13/480,793

(22) Filed: May 25, 2012

(65) Prior Publication Data

US 2013/0284544 A1 Oct. 31, 2013

(30) Foreign Application Priority Data

Apr. 26, 2012 (EP) ..... 12002963

(51) Int. Cl.
*B66B 1/34* (2006.01)

(52) U.S. Cl.
CPC ..... *B66B 1/3492* (2013.01)
USPC ..... 187/394; 187/414

(58) Field of Classification Search
USPC ..... 187/247, 391, 394, 414
See application file for complete search history.

(56) References Cited

U.S. PATENT DOCUMENTS

| | | | | | |
|---|---|---|---|---|---|
| 3,963,098 | A * | 6/1976 | Lewis et al. | 187/394 |
| 4,134,476 | A * | 1/1979 | Zolnerovich et al. | 187/394 |
| 4,427,095 | A * | 1/1984 | Payne et al. | 187/394 |
| 4,433,756 | A * | 2/1984 | Caputo et al. | 187/394 |
| 4,674,603 | A * | 6/1987 | Estrella | 187/394 |
| 4,750,592 | A * | 6/1988 | Watt | 187/394 |
| 4,798,267 | A * | 1/1989 | Foster et al. | 187/389 |
| 5,135,081 | A * | 8/1992 | Watt et al. | 187/394 |
| 5,925,859 | A * | 7/1999 | Miller et al. | 187/394 |
| 6,435,315 | B1 * | 8/2002 | Zaharia | 187/394 |
| 6,945,296 | B2 * | 9/2005 | Kunz | 156/391 |
| 6,986,409 | B2 * | 1/2006 | Birbaumer | 187/394 |
| 7,669,698 | B2 * | 3/2010 | Jahkonen | 187/394 |
| 2002/0104716 | A1 | 8/2002 | Zaharia | |

FOREIGN PATENT DOCUMENTS

JP 07-277624 A1 10/1995

OTHER PUBLICATIONS

European Search Report dated Oct. 5, 2012.

* cited by examiner

*Primary Examiner* — Anthony Salata
(74) *Attorney, Agent, or Firm* — Burr & Brown, PLLC

(57) ABSTRACT

An elevator installation with an elevator cab in an elevator shaft and a measurement tape for determining the position of the elevator cab within the elevator shaft, which measurement tape is arranged vertically in the elevator shaft and has a code along the measurement tape, and at least one marking element which is attached in the elevator shaft and has a reference marking, and a sensor apparatus which is attached to the elevator cab and includes an illumination source and a sensor, which form a detection field for detecting the measurement tape and with an evaluation apparatus. The reference marking is arranged such that it can be captured by the detection field and the sensor apparatus is also provided for detecting the reference marking and the evaluation apparatus aligns the position determined by the measurement tape with the reference marking.

13 Claims, 4 Drawing Sheets

ELEVATOR SHAFT POSITION MEASUREMENT APPARATUS

This application claims the benefit under 35 USC §119(a)-(d) of European Application No. 12 002 963.2 filed Apr. 26, 2012, the entirety of which is incorporated herein by reference.

FIELD OF THE INVENTION

The invention relates to an elevator installation, and also to a marking device, a measurement apparatus and a guide element for an elevator installation.

BACKGROUND OF THE INVENTION

The prior art has disclosed elevator installations that capture the position of the cab by means of a code band hanging in the elevator shaft and a sensor on the elevator cab for detecting the code band.

SUMMARY OF THE INVENTION

It is an object of the invention to develop the prior art.

Accordingly, an elevator installation according to the invention is distinguished by virtue of the fact that it comprises an elevator cab in an elevator shaft and that it comprises a measurement tape for determining the position of the elevator cab within the elevator shaft, which measurement tape is arranged vertically in the elevator shaft and has a code for measuring length along the measurement tape, and that it comprises at least one marking element which is attached in the elevator shaft and has a reference marking, and that it comprises a sensor apparatus which is attached to the elevator cab and comprises an illumination source and a sensor, which form a detection field for detecting the measurement tape and that it comprises an evaluation apparatus, wherein the reference marking is arranged such that it can be captured by the detection field and the sensor apparatus is also provided for detecting the reference marking and the evaluation apparatus aligns the position determined by the measurement tape with the reference marking.

Accordingly, the marking device according to the invention is distinguished by the fact that it is provided for marking and/or encoding the position of an elevator cab within an elevator shaft and for the attachment within the elevator shaft, more particularly on the shaft wall, and comprises a measurement tape for the vertical arrangement along the elevator shaft, which measurement tape has a code for determining the position along the measurement tape, and that it comprises at least one guide element for mounting the measurement tape in a longitudinally moveable manner within the elevator shaft, more particularly on the shaft wall, wherein at least one guide element has a reference marking for marking a specific position within the elevator shaft.

Accordingly, the measurement apparatus according to the invention is distinguished by the fact that it is provided for determining the position of an elevator cab within an elevator shaft and that it comprises the aforementioned marking apparatus and that it comprises a sensor apparatus for attachment to the elevator cab with an illumination source and a sensor for detecting the measurement tape and the reference marking, and that it comprises an evaluation apparatus for aligning the position determined by the measurement tape to the reference marking, wherein the reference marking is arranged in the detection region of the sensor and the sensor for detecting the measurement tape at the position of a reference marking detects the reference marking.

Accordingly, the guide element according to the invention is distinguished by the fact that it is provided for mounting a measurement tape in a longitudinally moveable manner within an elevator shaft, more particularly on the shaft wall, wherein the guide element has a reference marking for marking a specific position within the elevator shaft.

The invention can enable the alignment of the reference marking with the measurement tape using only one sensor and can thus dispense with a further sensor for the reference marking. A displacement of the measurement tape with respect to the level openings of the elevator installation can thus be identified and corrected.

The measurement tape preferably extends over at least one level height, more particularly over at least two level heights, advantageously also over all level heights of the elevator installation. This can enable continuous position information in respect of the position of the elevator cab in the elevator shaft.

The measurement tape is preferably attached in a hanging manner in the elevator shaft. An advantage of this can be that the measurement tape is not influenced by a change in the support, e.g. by the compression of the building or of the chassis of the elevator.

The measurement tape is preferably attached to the elevator shaft on the ceiling or on the wall in the upper travel region of the elevator cab. An advantage of this can be that the measurement tape does not expand or contract with a possible expansion or change in the elevator frame. However, the measurement tape could also be attached to the elevator frame.

The marking element at the same time preferably is a guide element for the measurement tape for mounting the measurement tape in the longitudinal direction within the elevator shaft, wherein the guide element has guide areas for the longitudinally moveable mounting of the measurement tape within the elevator shaft, more particularly on the shaft wall. This dual function makes it possible to dispense with additional elements.

The guide element is preferably attached to the wall of the elevator shaft in accordance with an attachment of the measurement tape on the ceiling or wall of the elevator shaft.

The marking element is preferably placed in correlation to the shaft door openings. This can enable an identification of the position of the shaft door openings. The marking element is particularly advantageously positioned such that it is captured by the sensor when the floor of the elevator cab is level with the floor of a level. In particular, a number of marking elements can be positioned at the same distance from the floor planes of the level openings of the elevator shaft.

The measurement tape preferably respectively has an encoding region running along its length, for holding the code, and at least one mounting region for mounting in the guide elements. More particularly, the mounting region can run along the edges of the measurement tape on both sides and the encoding region can run between the mounting regions on both sides. An advantage of this can be that the mounting of the measurement tape does not impede the detection of the code.

The guide element preferably at least partly engages around the measurement tape. More particularly, the guide element can at least partly engage around the measurement tape in the mounting region. The guide element preferably leaves the measurement tape uncovered in the encoding region.

The reference marking preferably at least partly covers the measurement tape. More particularly, the reference marking can at least partly cover the measurement tape in the mounting region. Advantageously, the reference region leaves the encoding region uncovered for the detection by the sensor apparatus. It is particularly advantageous for the reference marking to be arranged on both sides of the encoding region. This arrangement on both sides can lead to at least one of the two reference markings always lying within the tolerance region of the detection field of the sensor apparatus. This is due to the fact that the detection field is preferably wider than the encoding region in order to compensate for an offset of the sensor apparatus perpendicular to the measurement tape, as may occur as a result of e.g. the swinging of the elevator cab.

The code is preferably an optical code, more particularly IR (infrared) sensitive. The reference marking is preferably an optical marking, more particularly IR sensitive. The sensor is preferably an optical sensor, preferably an IR sensor. The sensor is preferably a matrix sensor. The code is preferably a matrix code. The sensor is preferably an imaging camera.

The code of the measurement tape can be provided such that it continuously changes over the measurement tape such that there are no repetitions in the code. The code can have a unique position indicator over the whole length of the measurement tape. As a result, it is also possible to identify the position uniquely even after the failure of detection.

The reference marking can also contain encoded information in respect of the presence of a level opening or the individual identification of the various level openings, for the detection by the sensor. The alignment of the evaluation apparatus can comprise the calibration of the measurement tape and/or the assignment of the various level openings to the position data.

BRIEF DESCRIPTION OF THE DRAWINGS

Exemplary embodiments of the invention are illustrated in the drawings and will be explained in more detail in the following text. The same reference signs in the individual figures in this case denote the same elements.

DETAILED DESCRIPTION OF THE INVENTION

Figure 1:
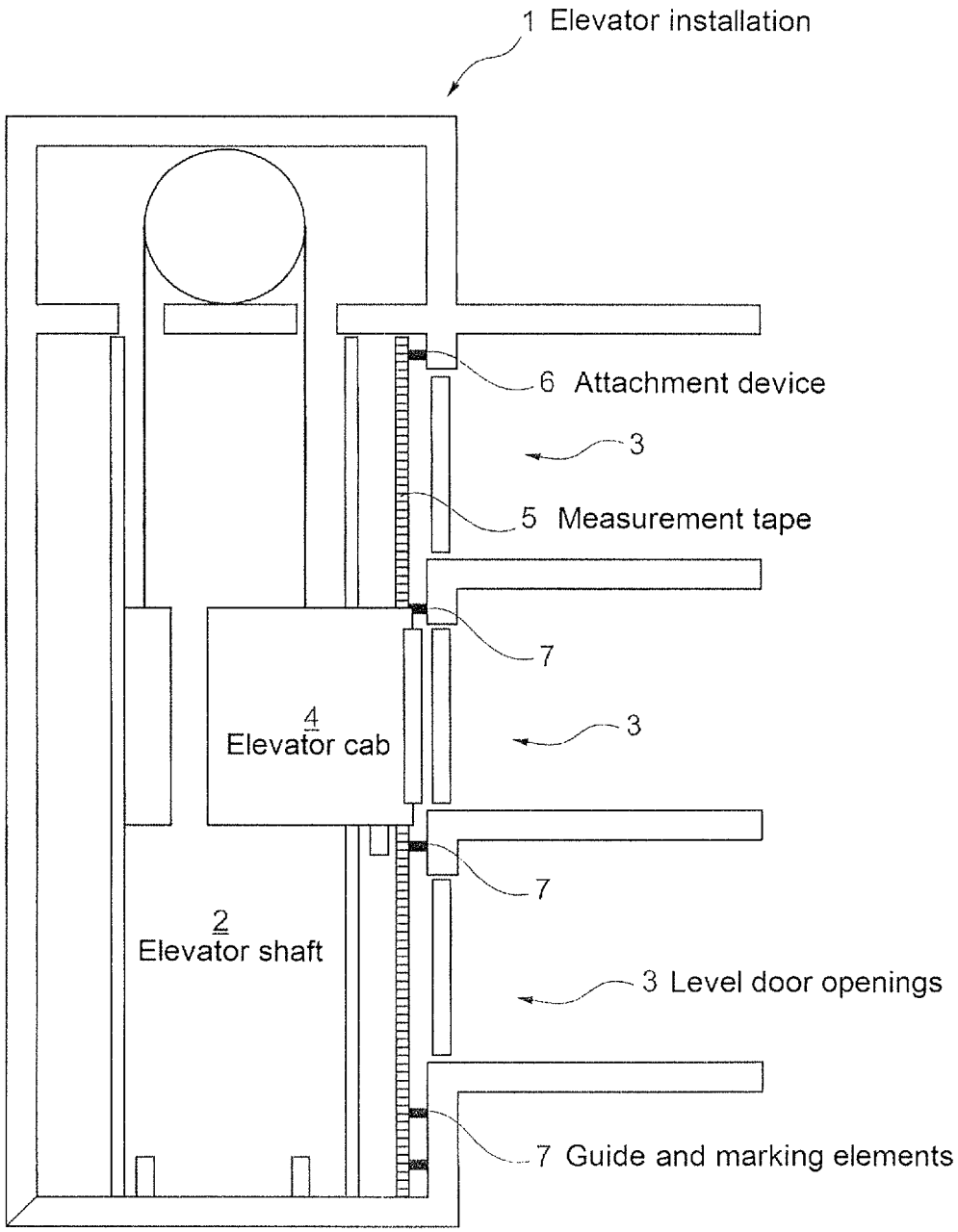
FIG. 1 shows a lateral section of an elevator installation.

FIG. 1 shows a lateral section of an elevator installation 1 with an elevator shaft 2 with level door openings 3, with an elevator cab 4, a measurement tape 5, an attachment device 6 for the measurement tape, and guide and marking elements 7. Under the floor of the elevator cab, the sensor 4*b* is attached thereto, said sensor currently being situated opposite a guide and marking element 7 and at the same time detecting the measurement tape and the reference marking.

Figure 2:
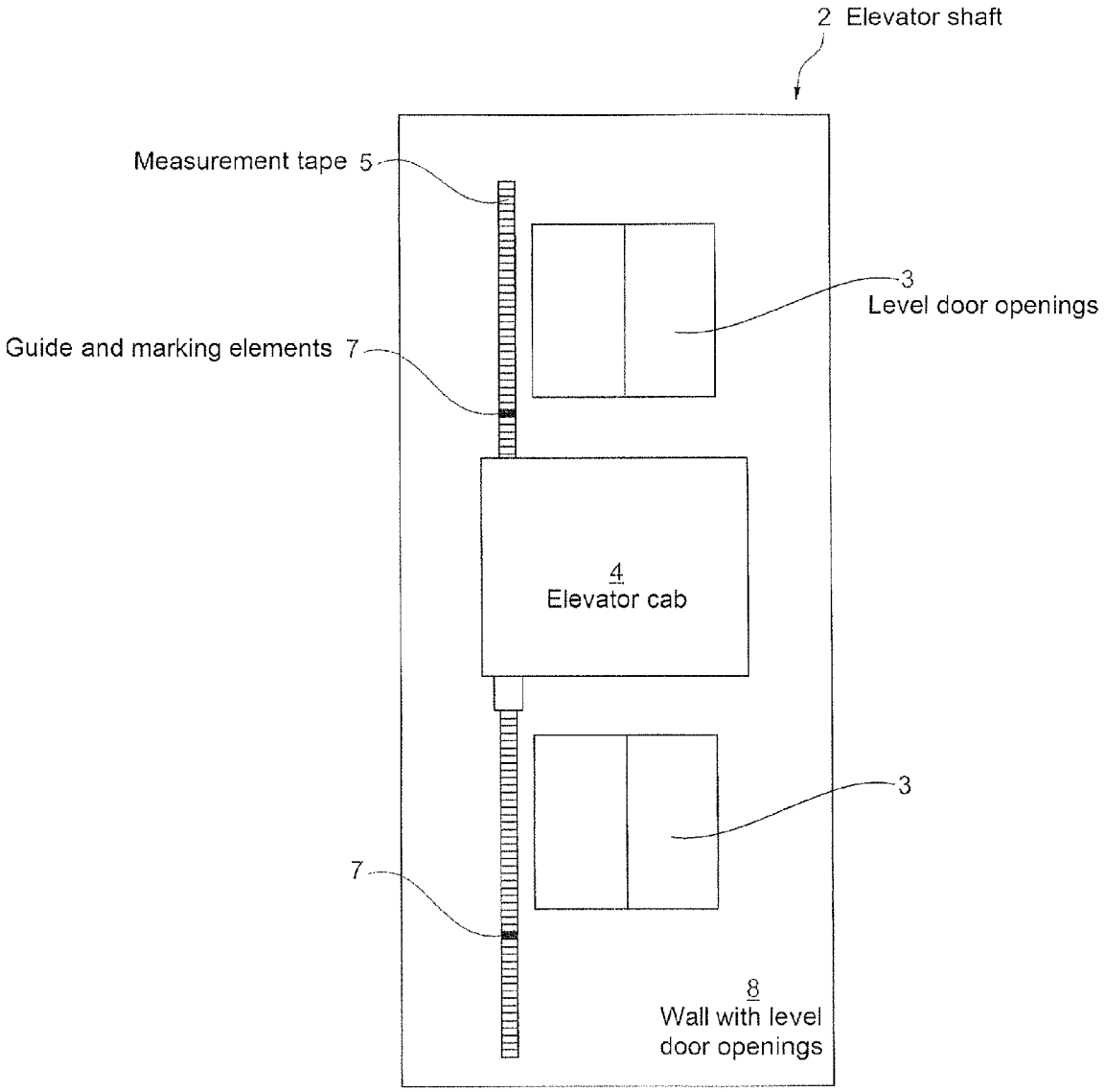
FIG. 2 shows a wall of an elevator installation with the shaft door openings.

FIG. 2 shows the wall 8 of an elevator shaft 2 with the level door openings 3 and the elevator cab 4. The guide and marking elements 7 are attached to the wall at constant distance from the level door openings and guide the measurement tape 5.

Figure 3:
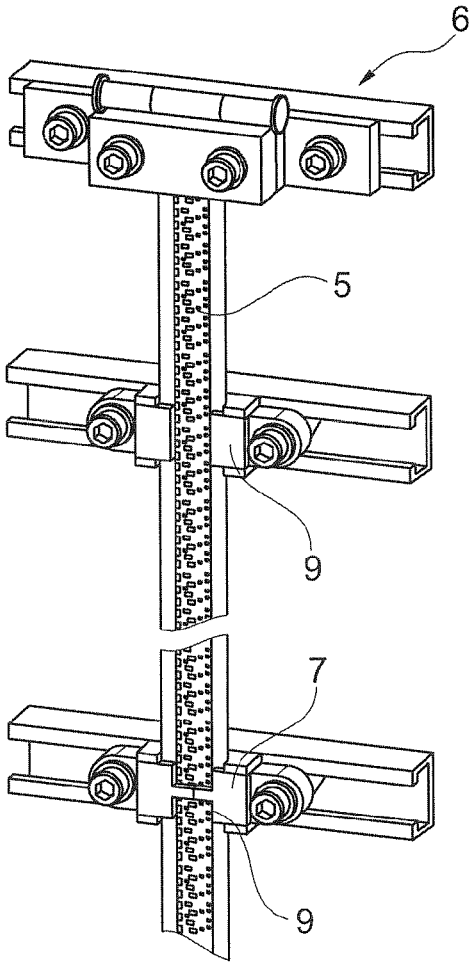
FIG. 3 shows a measurement tape with attachment, guide element and marking element.

FIG. 3 shows a measurement tape with an attachment device 6 situated at the top, a pure guide element 9 without markings and a guide and marking element 7 with a finger-shaped reference marking 9. The measurement tape is affixed in a stationary manner by the attachment device 6 and mounted within the guide element and the guide and marking element in a longitudinally displaceable manner.

Figure 4:
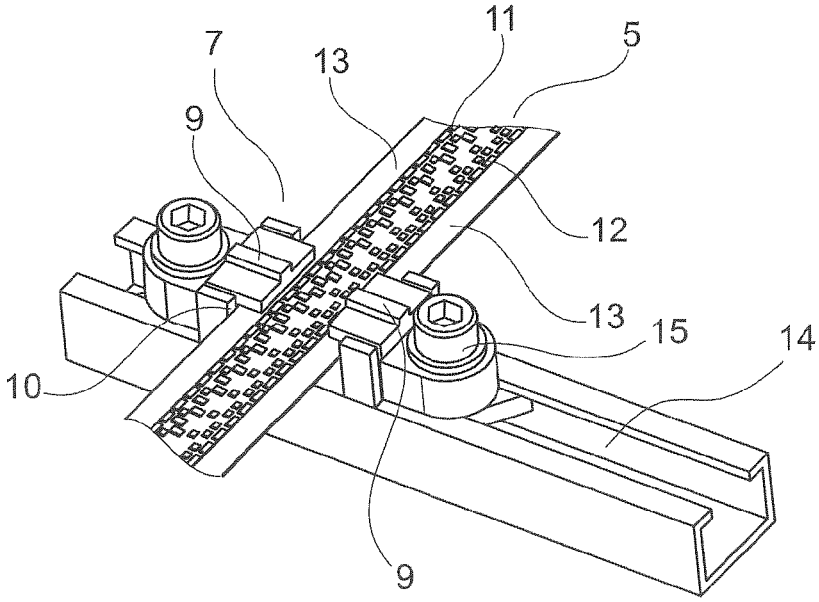
FIG. 4 shows a guide and marking element.

FIG. 4 shows a measurement tape 5 with an encoded region 11 with a code 12 and two mounting regions 13. A guide and marking element 7 is attached to an assembly rail 14 by assembly means 15. The assembly rail is provided for assembly on the elevator wall. The guide and marking element has guide areas 10 and reference markings 9 on both sides of the encoded region, comprises the measurement tape in the mounting region 13 and leaves the encoded region 11 uncovered. The measurement tape can be displaced in the longitudinal direction.

Figure 5:
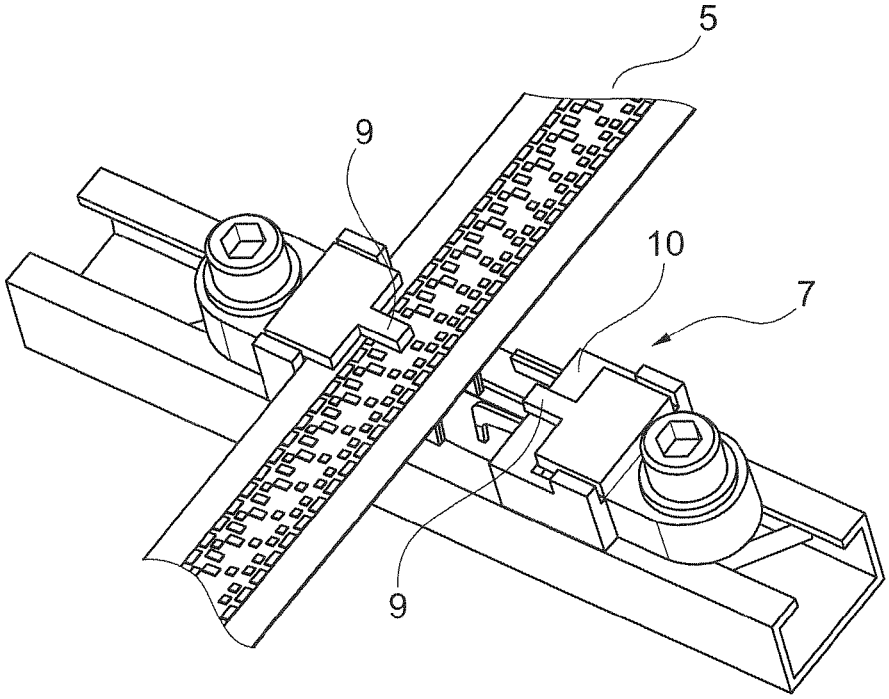
FIG. 5 shows another guide and marking element.

FIG. 5 shows a further embodiment of the guide and marking element 7 that is equipped with a snap-on mechanism for assembling the measurement tape, said snap-on mechanism easily making it possible to introduce the guide and marking element laterally over the measurement tape.

Figure 6:
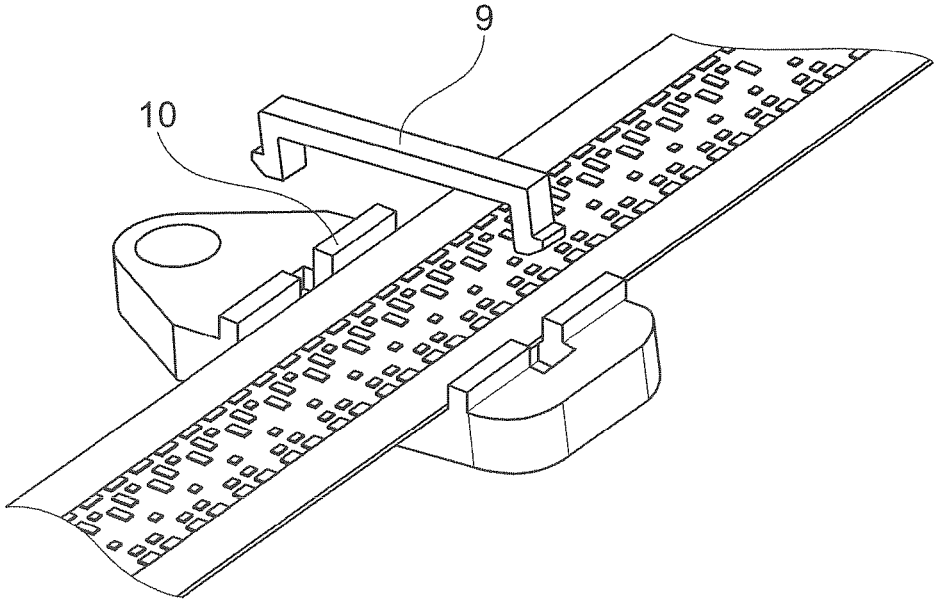
FIG. 6 shows a further guide and marking element.

FIG. 6 shows a further embodiment of the guide and marking element 7, in which the support of the reference marking is equipped with a snap-on mechanism which easily makes it possible to introduce the measurement tape from above into the guide and marking element.

LIST OF REFERENCE SIGNS

1 Elevator installation
2 Elevator shaft
3 Level door openings
4 Elevator cab
5 Measurement tape
6 Attachment device
7 Guide- and marking elements
8 Wall with level door openings
9 Reference marking
10 Guide areas
11 Encoded region
12 Code
13 Mounting region
14 Assembly rail
15 Assembly means

We claim:

1. An elevator installation with an elevator cab in an elevator shaft and with a measurement tape for determining the position of the elevator cab within the elevator shaft, which measurement tape is arranged vertically in the elevator shaft and has a code along the measurement tape, and with at least one marking element which is attached in the elevator shaft and has a reference marking, and with a sensor apparatus which is attached to the elevator cab and comprises an illumination source and a sensor, which form a detection field for detecting the measurement tape and with an evaluation apparatus wherein the reference marking is arranged such that it can be captured by the detection field and the sensor apparatus is also provided for detecting the reference marking and the evaluation apparatus aligns the position determined by the measurement tape with the reference marking, and wherein the marking element guides longitudinal movement of the measurement tape.

2. The elevator installation according to claim 1, wherein the measurement tape extends over at least one level height, more particularly over at least two, and/or is attached in a hanging manner and/or is attached to the elevator shaft on the ceiling or on the wall in the upper travel region of the cab.

3. The elevator installation according to claim 1, wherein the marking element at the same time is a guide element for the measurement tape for mounting the measurement tape in the longitudinal direction within the elevator shaft and has guide areas for the longitudinally moveable mounting of the measurement tape within the elevator shaft, more particularly on the shaft wall.

4. The elevator installation according to claim 1, wherein the measurement tape respectively has an encoding region running along its length, for holding the code, and at least one mounting region for mounting in the guide elements, and/or the mounting region runs along the edges of the measurement tape on both sides and/or the encoding region runs between the mounting regions on both sides.

5. The elevator installation according to claim 1, wherein the guide element at least partly engages around the measurement tape, more particularly at least partly engages around the measurement tape in the mounting region, preferably leaves the measurement tape uncovered in the encoding region and/or the reference marking at least partly covers the measurement tape, more particularly at least partly covers the measurement tape in the mounting region and leaves it uncovered in the encoding region and/or is arranged on both sides of the encoding region.

6. The elevator installation according to claim 1, wherein the code is an optical code which can be captured by the sensor and the reference marking is an optical marking which can be captured by the same sensor as for the code.

7. A marking device for marking and/or encoding the position of an elevator cab within an elevator shaft and for the attachment within the elevator shaft, more particularly the shaft wall, with a measurement tape for the vertical arrangement along the elevator shaft, which measurement tape has a code for determining the position along the measurement tape, and with at least one guide element for mounting the measurement tape in a longitudinally moveable manner within the elevator shaft, more particularly on the shaft wall, wherein at least one guide element has a reference marking for marking a specific position within the elevator shaft.

8. The marking device according to claim 7, with an attachment apparatus for the stationary attachment of the measurement tape at one end, more particularly for hanging attachment.

9. The marking device according to claim 7, wherein the code is an optical code which can be captured by a sensor and the reference marking is an optical marking which can be captured by the same sensor as for the code.

10. The marking device according to claim 7, wherein the measurement tape has, running along its length, an encoding region for holding the code and at least one mounting region for mounting the measurement tape in the guide elements and/or the mounting region runs on both sides along the edges of the measurement tape and/or the encoding region runs between the mounting regions on both sides.

11. The marking device according to claim 7, wherein the guide element at least partly engages around the measurement tape on the sensor side, more particularly at least partly engages around the measurement tape on the sensor side in the mounting region, preferably leaving the measurement tape uncovered on the sensor side in the encoding region, and/or the reference marking at least partly covers the measurement tape on the sensor side, more particularly at least partly covers the measurement tape on the sensor side in the mounting region and leaves it uncovered on the sensor side in the encoding region, preferably arranged on the sensor side on both sides of the encoding region.

12. A measurement apparatus for determining the position of an elevator cab within an elevator shaft with a marking apparatus according to claim 1, with a sensor apparatus for detecting the measurement tape and the reference marking for attachment to the elevator cab with an illumination source and a sensor, with an evaluation apparatus for aligning the position determined by the measurement tape to the reference marking, wherein the reference marking is arranged in the detection region of the sensor and the sensor for detecting the measurement tape at the position of a reference marking detects the reference marking.

13. A guide element for mounting a measurement tape in a longitudinally moveable manner within an elevator shaft, more particularly on the shaft wall, wherein the guide element has a reference marking for marking a specific position within the elevator shaft.

* * * * *